US005195275A

United States Patent [19]

McLean

[11] Patent Number: 5,195,275

[45] Date of Patent: Mar. 23, 1993

[54] BLADE SHARPENER

[75] Inventor: Peter C. McLean, Heathridge, Australia

[73] Assignee: McLean Pty. Ltd., Doubleview, Australia

[21] Appl. No.: 646,775

[22] PCT Filed: Jun. 19, 1989

[86] PCT No.: PCT/AU89/00260

§ 371 Date: Feb. 5, 1991

§ 102(e) Date: Feb. 5, 1991

[87] PCT Pub. No.: WO89/12529

PCT Pub. Date: Dec. 28, 1989

[30] Foreign Application Priority Data

Jun. 20, 1988 [AU] Australia ..... PI8857

[51] Int. Cl.[5] ..... B24B 3/36

[52] U.S. Cl. ..... 51/69; 51/218 R; 51/221 BS; 269/71; 269/160; 269/269; 76/82.2

[58] Field of Search ..... 51/68, 69, 217 R, 217 T, 51/217 A, 218 R, 218 A, 220, 221 R, 221 BS, 166 TS, DIG. 15; 76/82, 82.2, 88; 269/3-4, 71, 87.3, 97-98, 160, 161, 269, 270

[56] References Cited

U.S. PATENT DOCUMENTS

| | | | |
|---|---|---|---|
| 688,146 | 12/1901 | Yeaton | 51/69 |
| 905,331 | 12/1908 | Larsen et al. | 51/69 |
| 961,010 | 6/1910 | Poitras et al. | 76/82.2 |
| 1,114,634 | 10/1914 | Neisler | 76/82.2 |
| 1,368,218 | 2/1921 | Chenette | 51/218 A |
| 1,541,835 | 6/1925 | McKinley | 76/82.2 |
| 1,955,366 | 4/1934 | Gupton | 51/218 R |
| 2,259,095 | 10/1941 | Alello, Sr. | |
| 2,528,943 | 11/1950 | Calabrese | 76/82.2 |
| 2,557,093 | 6/1951 | Garbarino | 76/82.2 |
| 2,644,279 | 7/1953 | Stankovich | 51/218 A |
| 3,053,019 | 9/1962 | Mozdy | |
| 4,216,627 | 8/1980 | Westrom | |
| 4,404,873 | 9/1983 | Radish | |
| 4,441,279 | 4/1984 | Storm et al. | |
| 4,471,951 | 9/1984 | LeVine | |
| 4,486,982 | 12/1984 | Longbrake | |
| 4,512,112 | 4/1985 | LeVine | |
| 4,583,382 | 9/1985 | Johannsen | |
| 4,714,239 | 12/1987 | LeVine | |
| 4,777,770 | 10/1988 | LeVine | |

FOREIGN PATENT DOCUMENTS

| | | |
|---|---|---|
| 29679/30 | 7/1931 | Australia |
| 1826/54 | 10/1955 | Australia |
| 4819/54 | 2/1956 | Australia |
| 26555/84 | 10/1984 | Australia |

*Primary Examiner*—Bruce M. Kisliuk
*Assistant Examiner*—John A. Marlott
*Attorney, Agent, or Firm*—Foley & Lardner

[57] ABSTRACT

A blade sharpener (10) comprising a frame (12) with a clamp (76) and a guide means (48) moveably attached to it to allow rotation of the clamp (76) about an axis (102), and raising and lowering of the guide means (48), both with respect to the frame (12), the clamp (76) having a first jaw (78) constructed to have various cutting instruments clamped to various surfaces of it to allow sharpening by a sharpening tool (156) carried by a sharpening member (158), a rod of the sharpening tool (158) being guided by guide means (48).

14 Claims, 8 Drawing Sheets

BLADE SHARPENER

DESCRIPTION

The present invention relates to a blade sharpener especially envisaged for use in sharpening cutting instruments such as knives, axes, scissors, shears, secateurs, choppers, chisels, buzzer blades, chain saws, circular saws and hand saws and the like.

FIELD OF THE INVENTION

Previously, to sharpen a blade, an abrasive wheel has been used. The wheel is rotated at speed and the blade is drawn across the wheel so as to sharpen an edge of the blade. The angle to which the edge of the blade is sharpened is generally judged by the eye of the person sharpening the blade.

Considerable skill and experience is required to accurately sharpen blades in such manner.

Also, abrasive wheels sharpen by grinding away from the edge which method is not preferred in sharpening blades. Blade sharpening is preferably curved out by grinding toward or into the edge.

Also, such wheels rotate at speeds which cause heat to build up during sharpening which causes subsequent loss of temper of the blade edge and hence more rapid dulling thereof with use.

Also sharpening with such wheels tends to lead to the production of an edge which is not as straight or as continuous as the original edge at manufacture. Thus, although the blade edge may be sharpened it generally becomes softer and less straight, which results in the need for more frequent sharpening and less efficient cutting with the blade edge.

This is particularly true of hair dressing scissors where blade edges must co-act to cut hair. Professional quality scissors are very expensive and once they loose their manufactured edge it is very difficult to re-establish a good edge with the use of prior art apparatus. It is known to use blade sharpeners comprising a clamp mechanism to hold a blade and allow movement of a sharpening tool at an angle to an edge of the blade. Such prior art blade sharpeners suffer from insufficient adjustability of both angle of sharpening and of the clamp mechanism, as a consequence of which they are capable of sharpening only certain blades.

For example, an edge of a knife is at an angle of about 15° to 35° to a body of the knife. Axes and chisels have similar edges to those of knives. However, scissors have blade edges at about 40° to 85° to a body of the scissor blade. Chain saw teeth and saw teeth have cutting edges requiring two angles requiring special prior art sharpening devices.

No single prior art blade sharpener is able to cope with such varieties of blade and edge types.

SUMMARY OF THE INVENTION

The present invention provides a blade sharpener which attempts to overcome the above difficulties. In accordance with the present invention there is provided a blade sharpener for sharpening an edge of a blade of a cutting instrument, the blade sharpener characterised in that it comprises:

(a) a frame having a first upright member, a second upright member disposed at right angles to the first upright member, and a base upon which the first upright member and the second upright member are mounted, the base being attachable upon a bench edge or the like;

(b) a guide means being attached to the first upright member and being height adjustable thereon;

(c) a clamp means having:

(i) a first jaw comprising a first end and a second end, a first surface and a second surface each of which extends between the first end and the second end, the first surface being substantially flat, the second surface having a ledge diverging from the first end toward the second end, the first end being relatively thin, a flange extending from a longitudinal edge of the first jaw and pivotally connected to the second upright member, a threaded hole disposed through the first jaw upon a centre line thereof; and (ii) means to clamp the cutting instrument against the first jaw at a location selected from a group consisting of, the ledge, the first surface and the second surface; and (d) a sharpening tool having a sharpening member and a rod fixed thereto, the rod being disposed to rest upon the guide means and to be guided thereby and the sharpening member being disposed to bear against either the edge or the blade of the cutting instrument to sharpen same.

BRIEF DESCRIPTION OF THE DRAWINGS

The present invention will now be described, by way of example, with reference to the accompanying drawings, in which.

DESCRIPTION OF THE INVENTION

Figure 1:
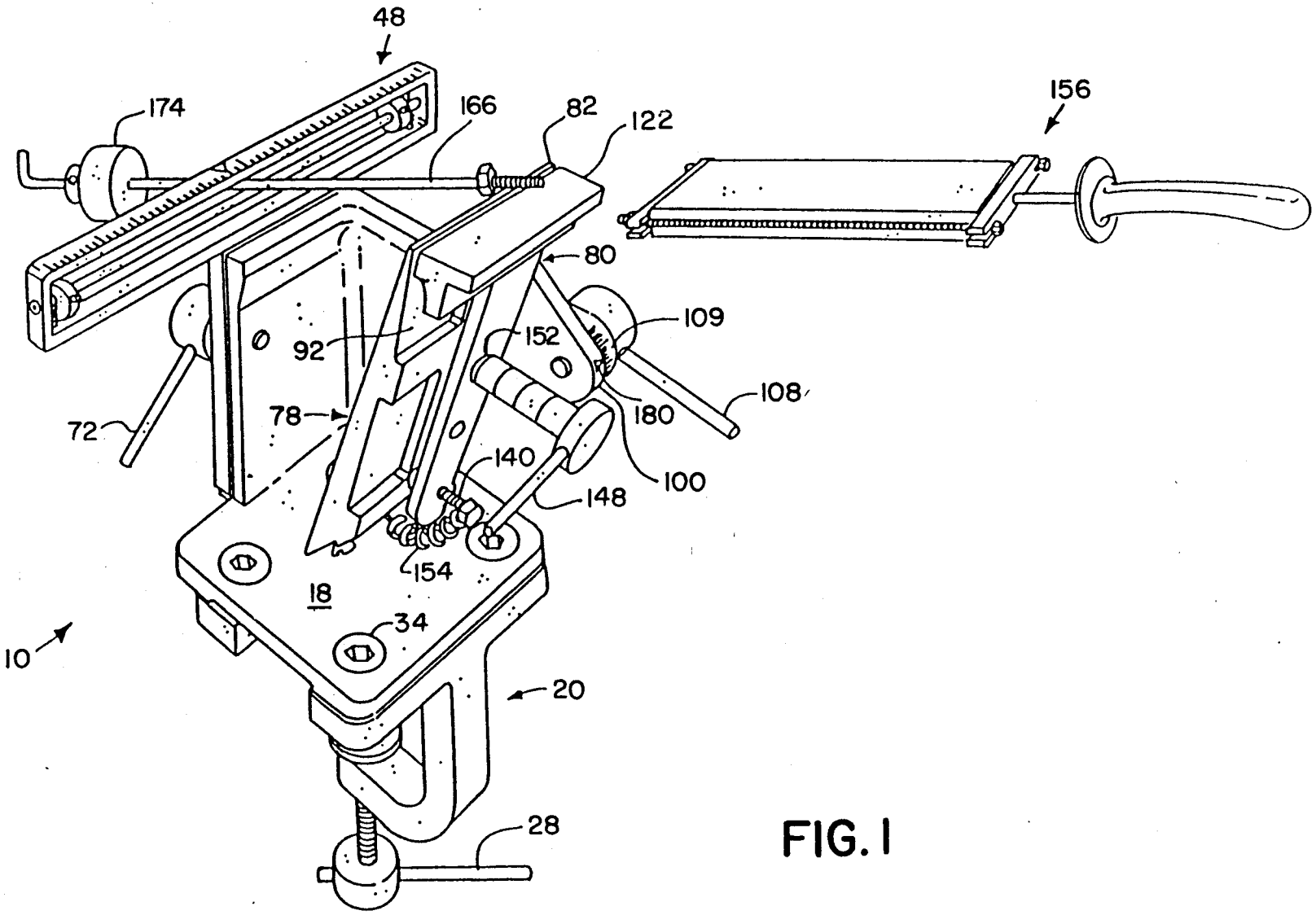
FIG. 1 is an upper perspective view of a blade sharpener in accordance with the present invention.

In the drawings there is shown a blade sharpener 10 comprising a frame 12 having a first upright member 14 and a second upright member 16, each mounted upon a base 18. The first and the second upright members 14 and 16 are substantially at right angles to each other. The base 18 is arranged to be disposed substantially horizontally when in use.

The blade sharpener 10 also comprises an attachment means 20 having a downwardly depending "J" shaped arm 22 bent intermediate its length and disposed substantially parallel to the base 18. The arm 22 has a threaded hole 23 adjacent its free end to receive a threaded rod 24 having a swivel cup 26 at an end adjacent the base 18 and a tommy bar 28 at its other end.

Figure 4:
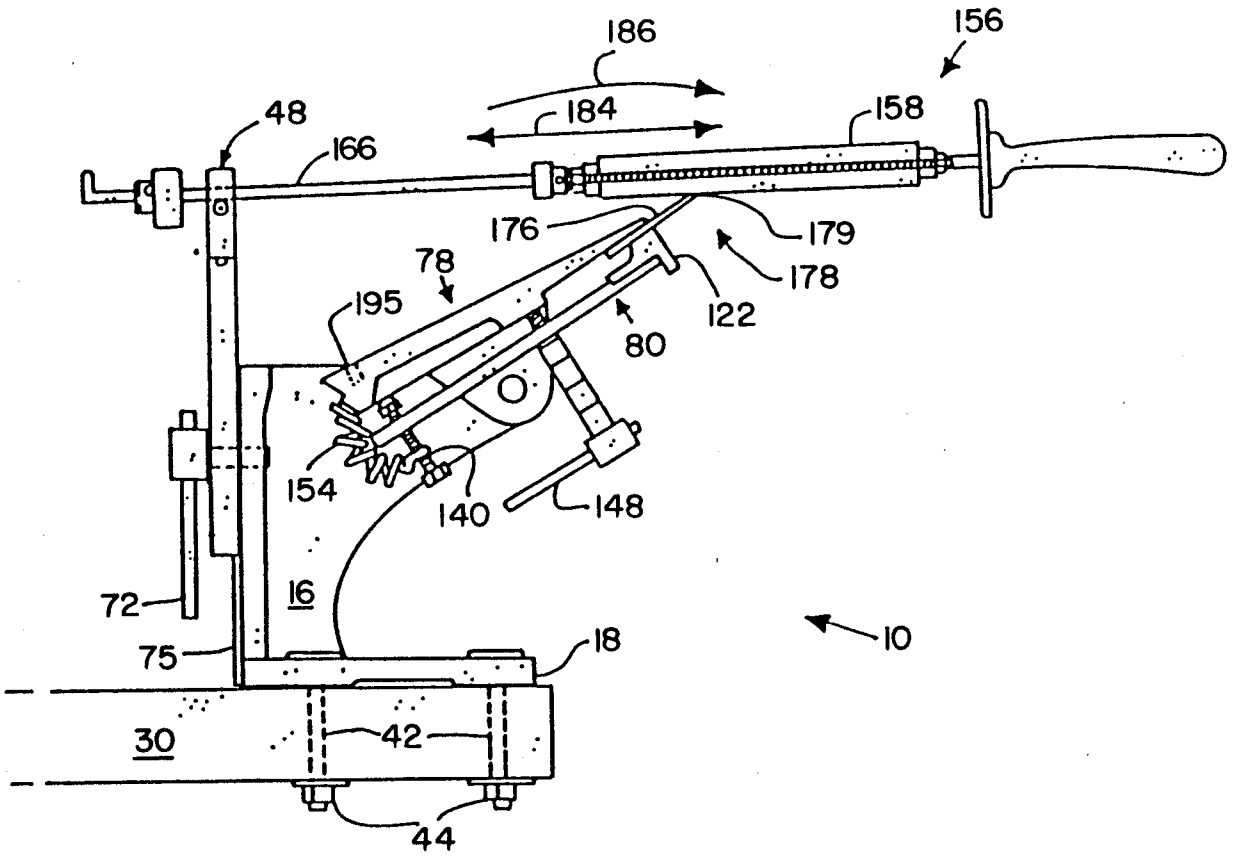
FIG. 4 is a side view of the blade sharpener of FIG. 1 shown in use attached to a bench edge and sharpening a blade.

The attachment means 20 constitutes a "J" clamp, and is used to secure the blade sharpener 10 to a bench edge 30 as shown in FIG. 4.

Figures 2, 2A:
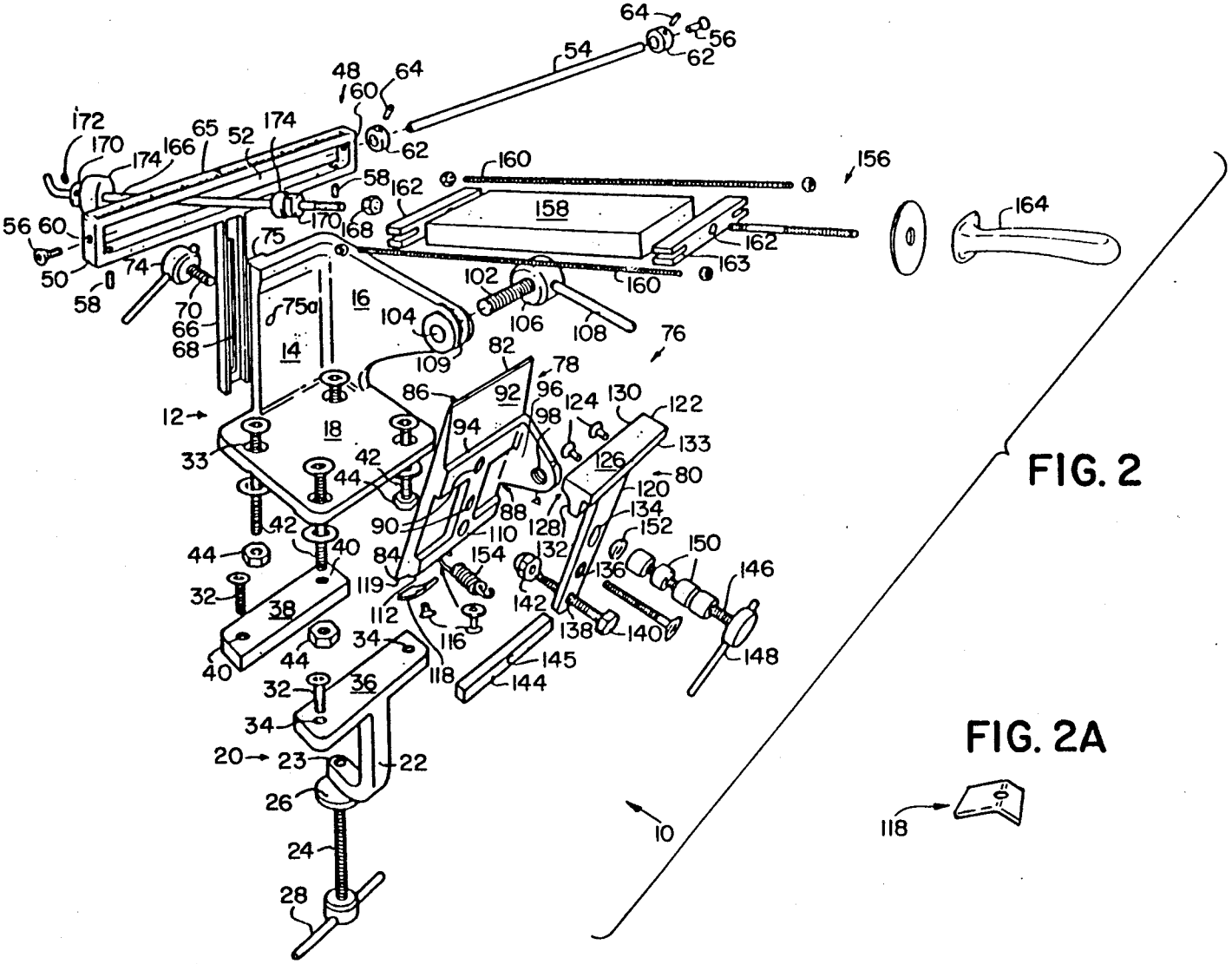
FIG. 2 is an exploded view of the blade sharpener of FIG. 1 showing two means for its mounting to a bench edge.
FIG. 2*a* is an upper perspective of a square clamp of the blade sharpener of FIG. 1.

The attachment means 20 is fixed to the base by bolts 32 passing through holes 33 in the base 18 and threaded engaging with threaded holes 34 in a bar 36 of the "J" shaped arm 22 as shown in FIG. 2.

The base comprises a spacer 38 of equal thickness to the bar 36 and having threaded holes 40 to receive further bolts 32 through further holes 33 in the base 18.

The base 18 is also provided with bolts 42 (see FIG. 4) to allow direct fixing of the base 18 to the bench edge 30 with nuts 44 and without use of the attachment means 20 and the spacer 38.

The blade sharpener 10 also comprises a guide means 48, referred to as a "T" bar, having an elongated member 50 with a longitudinal slot 52.

The longitudinal slot 52 has a rod 54 secured in it with studs 56 and grub screws 58 to adjust the disposition of the rod 54 in the longitudinal slot 52. The studs 56 are received in slots 60 located in opposite ends of the elongated member.

The rod 54 has slidable stops 62 located upon it and each fixable in position with a further grub screw 64. The elongated member 50 has a measuring scale 65 fixed to its upper edge. Typically, the scale 65 is zeroed at a centre of the length of the elongated member 50. Typically, the scale 65 is graduated in millimetres.

The guide means 48 also comprises a channelled bar 66 joined intermediate the length of the elongated member 50 and extending at right angles thereto. The channelled bar 66 is also disposed at right angles of a plane drawn through the longitudinal slot 52.

The channelled bar 66 has a longitudinal slot 68 to receive a bolt 70 with a tommy bar 72 located in its head 74. The longitudinal slot 68 allows for movement of the channelled bar 66 with respect to the bolt 70 and in the direction of the longitudinal slot 68.

Figure 3:
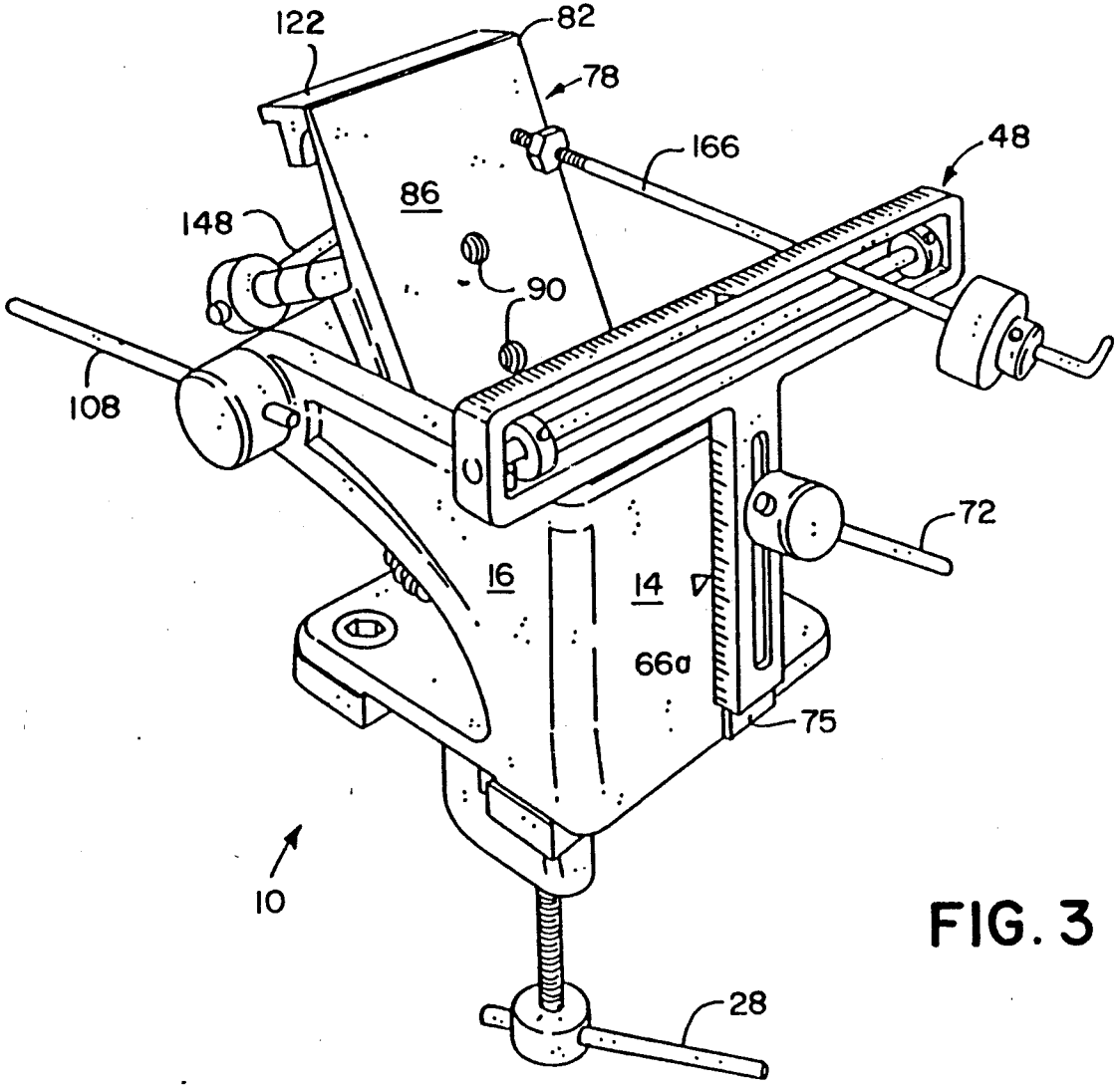
FIG. 3 is a rear upper perspective view of the blade sharpener of FIG. 1.

The channelled bar 66 also comprises a measuring scale **66*a* fixed along its length as shown in FIG. 3. The scale 66*a*** is typically graduated in millimetres.

The first upright member 14 comprises a rib 75 disposed vertically thereon and shaped to be received in the channelled bar 6 t allow vertical movement of the guide means 48 with respect to the frame 12 (see FIGS. 2 and 3). A threaded hole **75*a* extends through the rib 75 to receive the bolt 70 to enable adjustable fixing of the guide means 48 with respect to the frame 12**.

The blade sharpener 10 also comprises a clamp means 76 having a first jaw 78 and a second jaw 80. The first jaw 78 comprises a first end 82 and a second end 84 having a first surface 86 and a second surface 88 disposed therebetween. The first surface 86 is flat between the first and second ends 82 and 84 and has two threaded holes 90 disposed through it, and along a centre line thereof, as shown in FIG. 3. The holes 90 also extend through the second surface 88. The second surface 88 comprises a ledge 92 diverging from the first end 82 toward the second end 84 and terminating at a shoulder 94 transverse of and intermediate the length of the first jaw 78. The shoulder 94 is preferably machined true and at right angles to longitudinal sides of the first jaw 78.

The first jaw 78 at the first end 82 is relatively thin compared to the remainder of the first jaw 78, such as for example, between 0.5 to 2 mm, typically about 1 mm thick. The thickness cf the ledge 92 at the shoulder is set to be thick enough to provide sufficient strength to support blades to be sharpened but to be sufficiently thin to provide a small minimum sharpening angle, such as, for example 5°. The first jaw 78 also comprises a flange 96 extending from a longitudinal edge thereof and at right angles to the second surface 88. The flange 96 is typically triangular in shape and has a threaded hole 98 located adjacent its apex 100. The hole 98 is disposed to receive a bolt 102 located in a hole 104 in the second upright member 16, the bolt 102 having a head 106 with a tommy bar 108. Loosening of the bolt 102 with the tommy bar 108 and rotation of the first jaw 78 and retightening of the bolt 102 effects adjustable angular fixing of the first jaw 78 with respect to the second upright member 16.

The second upright member 16 has a measuring scale 109 located about the hole 104 as shown in FIG. 2. Typically, the scale 109 is graduated in degrees of angle. The scale 109 has a 90° graduation at its true vertical limit and a 0° graduation at its true horizontal limit.

The second surface 88 also comprises a detent 110 disposed in line with the holes 90 and toward the second end 84. The detent 110 is typically hemispherical.

Figure 7:
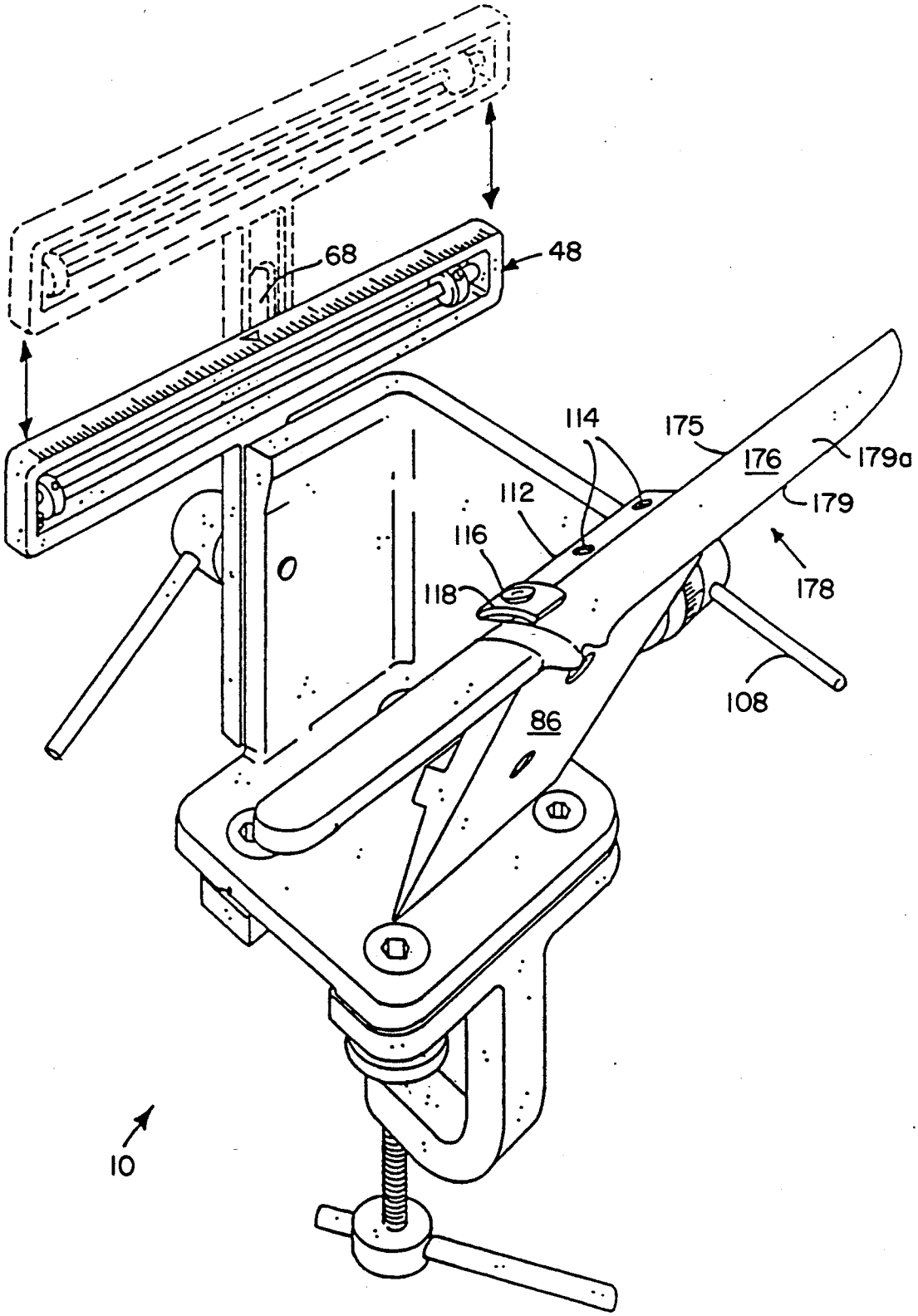
FIG. 7 is an upper perspective view of the blade sharpener of FIG. 1 shown adapted to remove a shoulder from a blade of a knife.

At the second end 84 the first jaw comprises a bevel 112 having three threaded holes 114, two of which are shown in FIG. 7. Two of the holes 114 are located at adjacent ends of the bevel 112 and the other hole 114 is located centrally of the bevel 112. The two said holes 114 are intended to receive a bolt 116 to fix a square clamp 118 (see FIG. **2*a*) to the second end 84 as shown in FIG. 7. The square clamp 118 is bent along its length to provide two edges of clamping, one on a blade and the other on the second end 84. Preferably, the bend is situated toward one edge of the square clamp 118 to provide more pressure on the blade. For this purpose the second end 84 has a shoulder 119 adjacent the bevel 112 to bear against a spine of the blade. The second jaw 80 comprises a leg 120 having attached to it at one end a clamp face 122. Attachment is effected by bolts 124 engaging through holes in the clamp face 122 into threaded holes in the leg 120**.

The clamp face 122 has a flat top 126 disposed at right angles to the leg 120 and a front face 128 having an edge 130 and an arcuate portion 132, the front face 128 being disposable toward the ledge 92 of the first jaw 78. The clamp face 122 is preferably extruded.

The edge 130 provides a surface for clamping and the arcuate portion 132 provides an access to receive, but not clamp, blades remote from their edge. Preferably, the edge 130 has longitudinal grooving to assist in clamping. The clamp face 122 also comprises a ledge 133 opposite the front face 128. The ledge 133 being disposed to retain a blade of a pair of hand shears, whilst the other blade is being sharpened.

It is to be noted that to enable clamping to a variety of instruments to be sharpened clamping should occur as close to an edge of the instrument as possible whilst clearing the remainder of the blade of the instrument to ensure that the edge is well clamped.

The leg 120 comprises a hole 134 located intermediate its length and having a concave bevelled lip. Preferably, the other side of the hole 134 also has a concave bevelled lip to inhibit catching against the bolt 146. The leg 120 also comprises a hole 136 located below the hole 134 and away from the clamp face 122. A threaded hole 138 is provided below the hole 136 and has retained therein a set screw 140 with a domed nut 142 to match the shape of the detent 110 in the first jaw 78. The set screw 140 allows adjustment of the angle of the second jaw 80 to the first jaw 78 to attain good contact between the edge 130 of the clamp face 122 and a blade to be sharpened, as described hereinafter. It is envisaged that a flat bar 144 with a central apertured hole 145 could be provided in place of the domed nut 142 to keep the jaws 78 and 80 parallel when desired, such as when sharpening chisels.

The clamp means 76 comprises a bolt 146 with a tommy bar 148 located in its head, the bolt 146 being disposed to pass into the hole 134 and to thread into the hole 90 adjacent the shoulder 94 to couple the first and second jaws 78 and 80 together. Typically the bolt 146 is provided with a plurality of spacers 150 to allow ready adjustment of the distance between the ledge 92 and the bracket 122 to clamp objects of various sizes.

The bolt 146 is also provided with a hemispherical washer 152 dimensioned to match the concave bevel of the hole 134 to allow for non parallel alignment of the first jaw 78 with the second jaw 80. The set screw 140 and the detent 110 co-act in a similar manner to this.

The clamp means 76 also comprises a resilient coupling between the second end 84 of the first jaw 78 and the leg 120 of the second jaw 80 remote from the clamp face 122. Typically, the resilient coupling is a spring 154 connected at one end to a free end of the set screw 140 and connected by a bolt similar to the bolt 116 into a centre one of the holes 114, as shown in FIGS. 1 and 4 respectively. Particularly as shown in FIG. 1 the spring 154 biases the clamp face 122 away from the ledge 92 to form a gap therebetween when the bolt 146 is part way or fully unwound. It is envisaged that other forms of resilient couplings could be used, such as a leaf spring or the like. The blade sharpener 10 also comprises a sharpening tool 156 having a sharpening bar such as in the form of a sharpening stone 158 held by bolts 160 between two brackets 162 having slots 163 in their ends, to one of which is threaded a handle 164 and to the other of which is threaded a rod 166. Typically locking nuts 168 are used to lock the handle 164 and the rod 166 to the respective brackets 162. Also, the handle 164 and the rod 166 may be interchanged with respect to the brackets 162 to allow better use of the stone 158. The slots 163 are elongated to allow stones 158 of various widths to be held between the brackets 162.

The rod 166 has a slidable stop 170 fixable along its length with a grub screw 172 and a resilient washer 174 is provided against the end stop 170. Preferably, the slidable stop 170 is the same as the slidable stops 62.

Typically, the rod 166 has another slidable stop 170 fixable adjacent the locking nut 168 with a grub screw 172 and with another resilient washer 174.

It is envisaged that the sharpening bar of the sharpening tool 156 of the embodiment of FIG. 2 could be in the form of a leather stop, or a sharpening stone having sides of various grades.

In use, the base 18 is either fixed to the table edge 30 using the bolts 42 and the nuts 44 or by using the attachment means 20, spacer 38 and bolts 32. In the latter case the tommy bar 28 is rotated to propel the bolt 24 in the threaded hole 23 to urge the cup 26 against the table edge 30 to clamp the blade sharpener 10 thereto. In the configuration shown in FIGS. 1 to 4 the slidable stops 62 may either be removed from the rod 54 or moved to extreme ends thereof. The slidable stops 62 are not intended to be used in this configuration. The tommy bar 148 is rotated to loosen the bolt 146 and spring the first and the second jaws 78 and 80 apart to receive a spine 175 of a blade 176 of an instrument such as a knife 178 having a cutting edge 179, as shown in FIG. 4. The blade 176 having a bevel 179*a* between the edge 179 and the spine 175. The tommy bar 148 is then rotated to urge the bracket 126 toward the ledge 92 to clamp the blade 176 therebetween.

The clamp means 76 is then rotated with respect to the second upright member 16 by loosening the bolt 102 with the tommy bar 108 and pivoting about the bolt 102 until the desired graduation is met on the scale 109. For this purpose the apex 100 of the flange 96 has reference marks 180 and 181. The reference mark 180 is used to measure angles of rotation for the ledge 92 and the reference mark 181 is used to measure angles of rotation for the first surface 86.

The graduation chosen is dependent upon the blade 176 to be sharpened. For blades 176 requiring a relatively thick edge, such as for large scissors and hedge clips and tin snips the clamp means 76 is disposed substantially upright to meet graduations of say more than 45° on the scale 109. For blades 176 requiring a relatively thin edge, such as for knives and axes and chisels, the clamp means 176 is disposed substantially horizontally to meet graduations of say between 45° to 0° on the scale 109. These angles are generally known to the skilled addressee.

The guide means 48 is then adjusted to a position level with the first end 82 of the first jaw 78. This results in a bevel true to the scale 109 being sharpened to the blade 176.

The rod 166 is then disposed through the longitudinal slot 52 above the rod 54 and is threaded into one of the brackets 162.

The slidable stops 170 are adjusted along the rod 166 and locked with the grub screw 172 to allow contact of substantially all of the sharpening stone 158 with the edge of the blade 176. This is to allow for even wear over the entire sharpening stone 158 and leads to longer life thereof, interchanging of the handle 164 and the rod 166 with respect to the brackets 162 also helps with this. It is to be understood that good quality sharpening stones 158 are quite expensive and therefore prolongation of their life is important.

The height of the guide means 48 with respect to the first upright member 14 is then adjusted, to be level with the first end 82 of the first jaw 78, by loosening the bolt 70 with the tommy bar 72 raising or lowering the elongated member 50 and retightening the bolt 70.

The height selected will depend on the nature of the blade 176 to be sharpened. The first upright member 14 has a reference marker 182 for this purpose, against which the scale 66*a* can be read.

Once the blade sharpener 10 is adjusted the sharpening stone 158 is rested upon the edge of the blade 176 and pushed into the edge, as shown in FIG. 4, toward the guide means 48 as indicated by arrow 184, which defines a forward stroke of the sharpening tool 156.

Simultaneously, the stone 158 is drawn along the length of the blade 176, preferably from a handle toward a tip of the knife 178. Scissors, on the other hand, are sharpened from a tip toward a handle of the scissors. Many various movements of the stone 158 can be used in this, such as, push and lift on return, as shown in FIG. 4, figure eight movements, circles or push and pull or the like. The resilient washer 174, such as a rubber stopper, is provided to hit against the elongated member 50 without damage thereto at the completion of the return stroke. It is envisaged that another resilient washer could be provided with the nut 168 to protect the elongated member 50 at the completion of the forward stroke.

The configuration shown in FIG. 4 is for sharpening scissors, axes, chisels, knives and the like. This configuration relies on the flat first surface 86 of the first jaw 78 to give good clearance to the stone 158. Blades of various thicknesses can be accommodated by removing some of the spacers 150. Blades that vary in thickness along their length are accommodated for by the hemispherical meeting of the washer 152 with the hole 134 and the bolt 140 with the detent 110. Blades 176 of various thicknesses from the spine 175 to the edge 179 are accommodated by adjustment of the set screw 140 in the hole 138.

It is envisaged that longer blades may be allowed for by using a longer clamp face 122.

Figures 5, 5A:
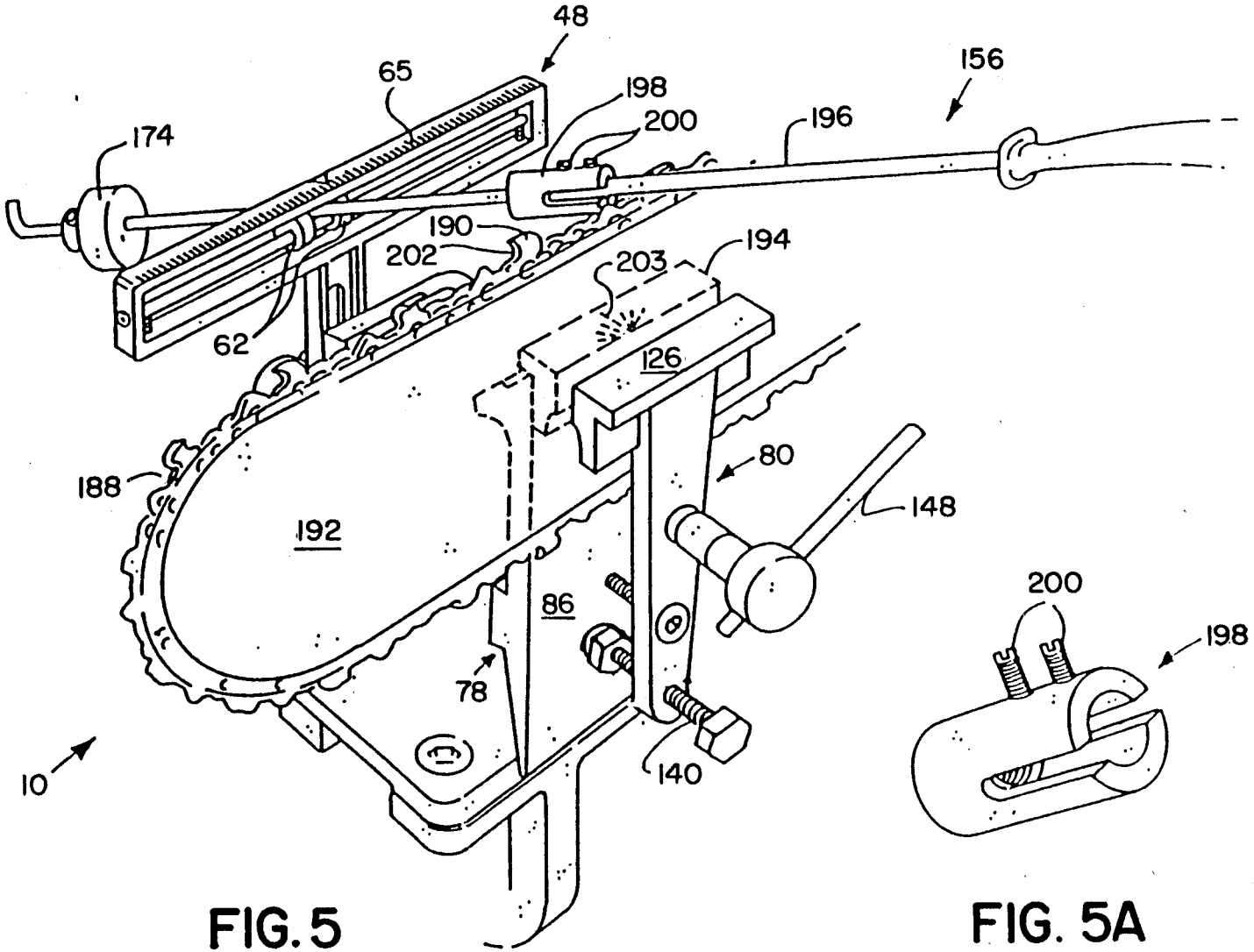
FIG. 5 is an upper perspective view of the blade sharpener of FIG. 1 shown adapted to sharpen teeth of a chain saw.
FIG. 5*a* is an upper perspective view of a file attachment for the configuration of FIG. 5.

FIG. 5 shows another configuration of the blade sharpener 10, especially for use in sharpening a chain saw blade 188 having teeth 190 disposed about a bar 192.

In this configuration the second jaw 80 is uncoupled from the first jaw 78 by unthreading the bolt 146 and disconnecting the spring from the set screw 140 and the bolt 116. A further clamp face 194 similar to the clamp face 122 is then bolted to the second end 84 of the first jaw 78 with bolts similar to the bolts 124 received in threaded holes 195 (see FIGS. 4 and 6). The first jaw is then rotated through about 180° so that the second end 84 is uppermost and the flat first surface 86 facing away from the guide means 48. The second jaw 80 is then fixed with the bolt 146 through the hole 134 to the first surface 86 of the first jaw 78 with the set screw 140 used to keep the leg 120 substantially parallel to the first surface 86, as shown in FIG. 5. The tommy bar 148 is rotated to clamp the bar 192 of the chain saw between the two clamp faces 122 and 194. The angle of the clamp means 76 is set to that specified for the blade 188 which may be between 0° to 10°, and position of the slidable stops 62 similarly adjusted, for example about 35°, or as recommended by the manufacturer. In this configuration the sharpening tool 156 comprises a chain saw file 196 for which purpose the rod 166 has a file attachment 198 (see FIG. 5*a*) typically with two grub screws 200 to fix the rod 166 to a free end of the file 196 remote from its handle 164.

The file attachment 198 allows sharpening bars in the form of round, flat or shaped files.

The slidable stops 62 are then fixed closely about the rod 166 to confine it against lateral movement. The stops 62 are positioned at distance along the scale 65 dependent upon the angle to which a gullet 202 of each of the teeth 190 is to be sharpened to.

One of the teeth 190 is then positioned, preferably top dead centre about the clamp face 194, the file 196 positioned in the gullet 202 and filing commenced.

For this purpose a centre of the clamp face 194 is intended to correspond with a central zero graduation of the scale 65*a*. It is intended that a center mark or a protractor marking 203 could be provided on the clamp face 194. It is also envisaged that a slidable protractor could be provided on the clamp face 194 and moveable from a central position to end positions of the clamp face 194.

Figure 6:
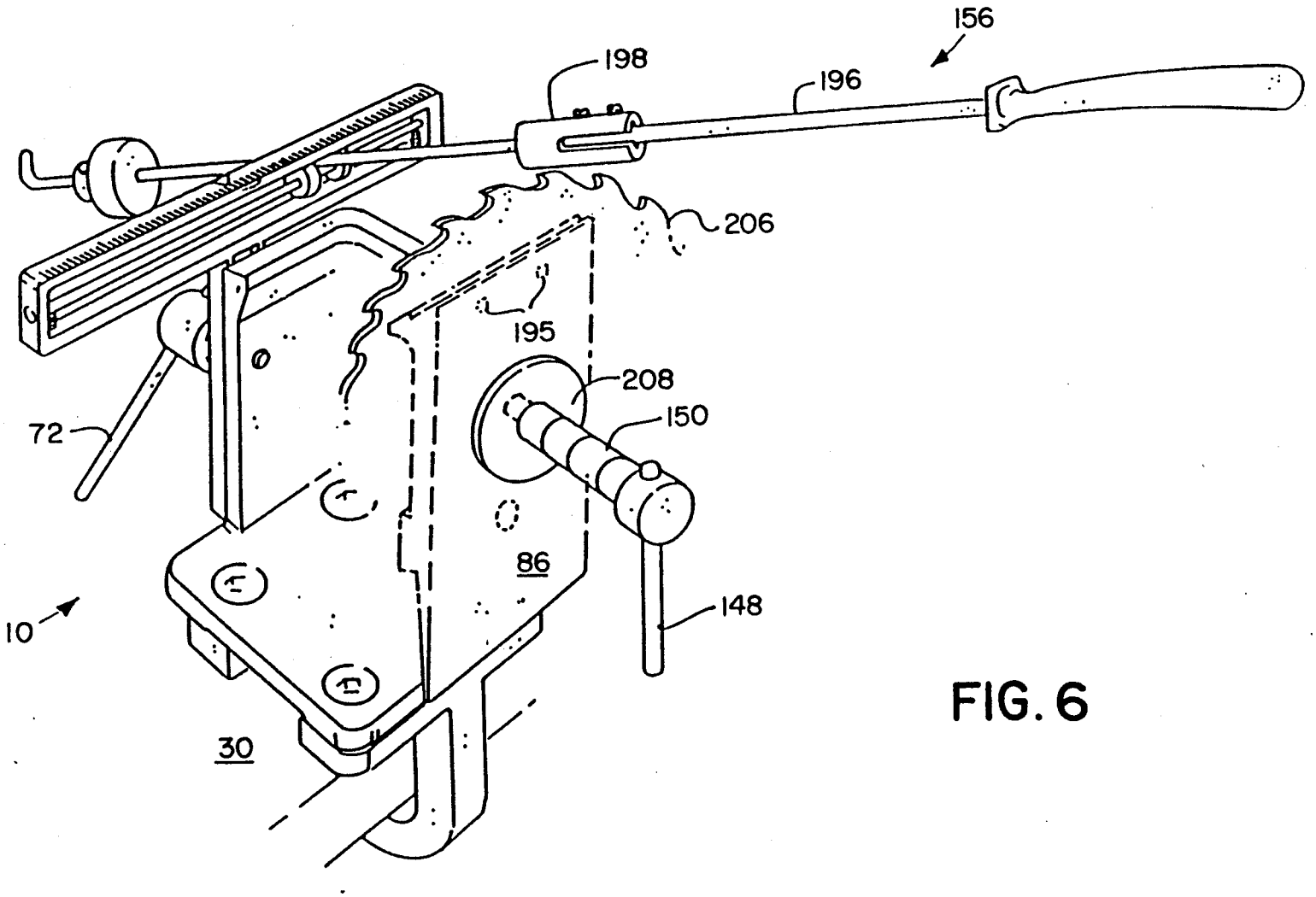
FIG. 6 is an upper perspective view of the blade sharpener of FIG. 1 shown attached to a table edge 8 adapted to sharpen teeth of a circular saw blade.

FIG. 6 shows yet another configuration of the blade sharpener 10, for use in sharpening teeth 204 of a circular saw blade 206. This configuration is similar to that of FIG. 5 except that the bolt 140 and the bracket 194 are removed and the bolt 146 is passed upon a washer 208 through a central hole of the saw blade 206. Typically, the washer 208*b* domed on one side to match a hole in the saw blade 206. In this way the saw blade 206 is clamped against the first surface 86 of the first jaw 78. Sharpening then proceeds the same as for chain saw blades 188, except that the bolt 146 must be loosened to allow rotation of the blade 206 to locate the next tooth 204 for sharpening. FIG. 7 shows a further configuration of the blade sharpener 10, for use in thinning the blade 176 of the knife 178. This becomes necessary when after continued sharpening the blade 176 becomes thicker at the bevel 179*a*. This configuration is similar to that of FIG. 6 except that the square clamp 118 is fixed into one of the end holes 114 of the first end 84 of the first jaw 78 to clamp the blade 176 to the first end 84.

The sharpening tool 156 is then drawn across and along the blade so as to make the blade thinner.

Figure 8:
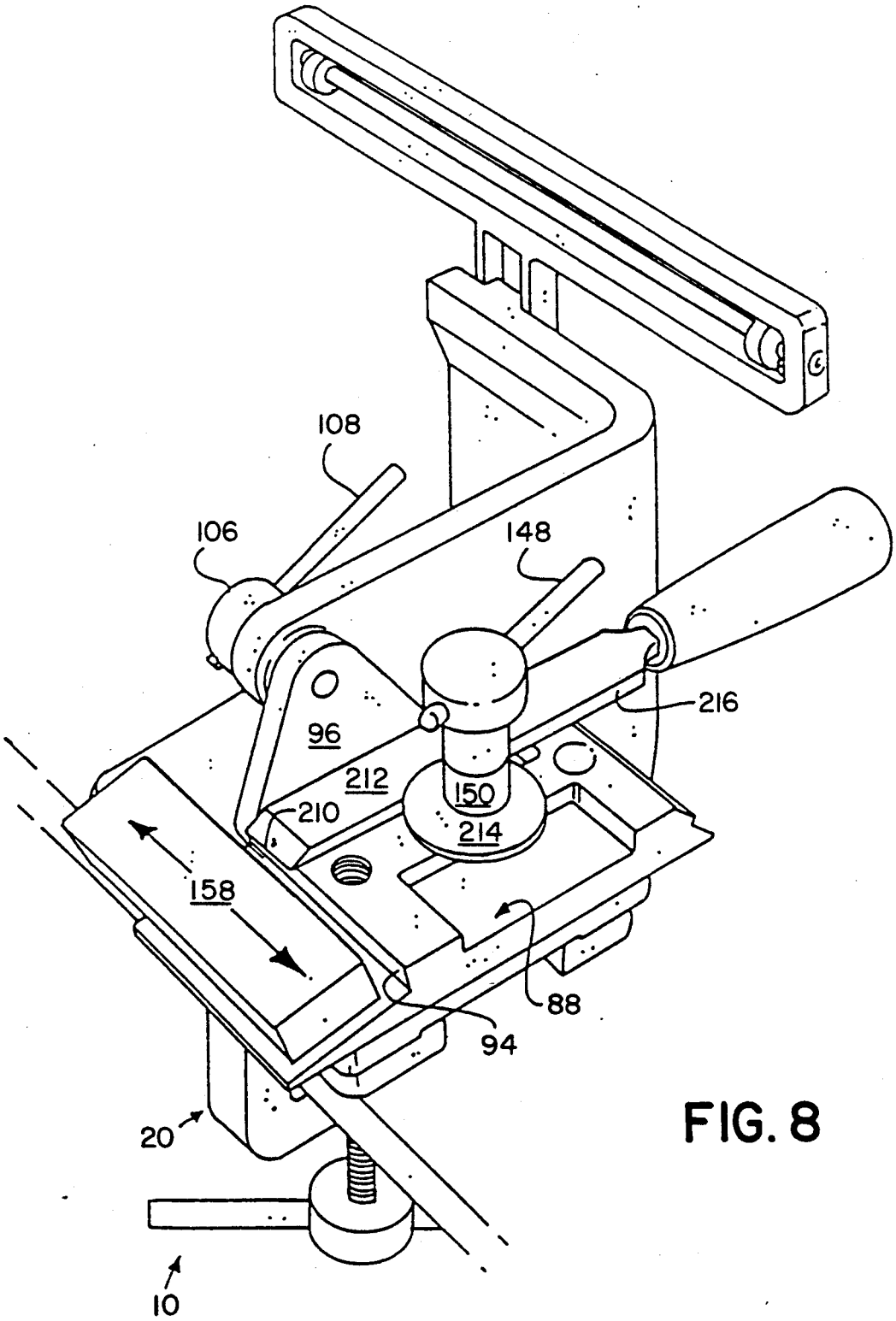
FIG. 8 is an upper perspective view of the blade sharpener of FIG. 1 shown adapted to square up an edge of a blade of a chisel.

FIG. 8 shows a still further configuration of the blade sharpener 10, for use in squaring up an edge 210 of a chisel blade 212. It is envisaged that other blades such as plane blades could also be squared up in this configuration. In this configuration the bolt 102 is completely unthreaded and the first jaw 78 positioned beside the second upright member 16 with its second surface 88 uppermost. The bolt 102 is then passed through the hole 104 from the base 18 side of the second upright member 16 and threaded into the threaded hole 98 of the flange 96. Typically the first jaw 78 is disposed substantially horizontally.

The bolt 146 is then passed through a washer 214 and into one of the threaded holes 90. The blade 212 is positioned beside the bolt 146 with a part of the washer 214 overlying it. The tommy bar 148 is then rotated to clamp the blade 212 to the second surface 88 and in doing so a side 216 of the blade 212 is made parallel with the longitudinal side of the first jaw 78.

The sharpening stone 158 is then positioned on the ledge 92, such as on rollers, with its side abutting the edge 210 of the blade 212. The stone 158 is then drawn back and forth across the ledge 92 until the edge 210 matches with the shoulder 94, at which time the edge 210 is truly square to the remainder of the blade 212.

Accordingly, the blade sharpener 10 of the present invention has a particularly novel clamp means 76 that allows clamping of a variety of blades in a variety of configurations to allow sharpening thereof. This is particularly facilitated by the co-action of the ledge 92, clamp faces 122 and 194, bolts 140 and 146, and the hemispherical couplings 134 and 152 and 110 and 142.

The blade sharpener 10 accordingly overcomes the problems of limited use of prior art sharpeners.

It is envisaged that the attachment means 198 could be modified to allow for a sharpening bar in the form of a power file.

Modifications and variations such as would be apparent to a skilled addressee are deemed within the scope of the present invention.

I claim:

1. A blade sharpener for sharpening an edge of a blade of a cutting instrument, comprising:

(a) a frame having a first upright member, a second upright member disposed at right angles to the first upright member, and a base upon which the first upright member and the second upright member are mounted, said base being attachable to a bench;

(b) guide means attached to said first upright member and capable of guiding a sharpening tool over the blade of said cutting instrument at an appropriate sharpening angle, said guide means comprising an elongated member comprising a pair of parallel guides forming a longitudinal slot therebetween, and a channelled bar with a longitudinal slot, said channelled bar extending from the elongated member to form a "T" bar therewith, said first upright member having a rib, said rib slidably receiving said channelled bar to provide height adjustment for the elongated member; and (c) a blade clamping means for holding the blade of said cutting instrument at a prescribed angle relative to the guide means wherein the sharpening tool can be guided by the guide means over the blade at said appropriate sharpening angle, the blade clamping means having:

(i) a first jaw comprising a relatively thin first end and a second end, a first surface and a second surface, said second surface facing in an opposite direction to said first surface, each of said surfaces extending between said first end and said second end, said first surface being substantially flat and said second surface having a ledge diverging from said first end towards said second end, a flange extending from a longitudinal edge of said first jaw and pivotally connecting said first jaw to said second upright member, whereby, in use, an angle of inclination of said first jaw can be pivotally adjusted through at least 180° in a plane substantially perpendicular to an edge of the blade of said cutting instrument; and (ii) means to clamp the cutting instrument against said first jaw at a location selected from a group consisting of the ledge, the first surface and the second surface whereby, in use, a blade of any cutting instrument selected from a group consisting of a knife, scissors, shears, clippers, an axe, a chisel, a saw and a chain saw, can be held in said blade clamping means at said prescribed angle to effect sharpening of the blade.

2. A blade sharpener according to claim ,1 in which said elongated member of said guide means has a measuring scale with a scale zero intermediate the length of said elongated member, said channelled bar of said guide means having a measuring scale, and said first upright mark of the frame having a reference member to measure against the measuring scale on said channelled bar.

3. A blade sharpener according to claim 1, further comprising a sharpening tool having a sharpening member and a rod fixed thereto, said rod being disposed to rest between said parallel guides of said guide means and to be guided thereby, said sharpening member being disposed to bear against an edge of the blade of said cutting instrument to sharpen the same, said rod having two slidable stops fixable both adjacent its ends and along its length, and a resilient washer provided against each of said slidable stops and disposed toward said elongated member.

4. A blade sharpener according to claim 1, in which said means to clamp said cutting instrument against said first surface of said first jaw comprises a bolt with a domed washer, said domed washer being adapted to abut said cutting instrument to clamp same to the first jaw.

5. A blade sharpener according to claim 1, in which said means to clamp said cutting instrument against the second end of the first jaw comprises a square clamp formed with a hole, two threaded holes located in said second end of said first jaw, and a bolt passed through said hole in a square clamp and into the one of said plurality of threaded holes in said second end of said first jaw, said second end of said first jaw comprising a bevel in which are disposed said threaded holes and a shoulder disposed to bear against a spine of said cutting instrument, said square clamp being operable to clamp said cutting instrument against said shoulder.

6. A blade sharpener according to claim 1, wherein said sharpening tool is selected from a group consisting of a sharpening stone, an abrasive file, a power file, and a strop.

7. A blade sharpener according to claim 1, in which said means to clamp said cutting instrument against said second surface of said first jaw comprises a bolt, and a washer on said bolt, said washer being adapted to abut said cutting instrument, said bolt being threaded into a threaded hole disposed through said first jaw from said second surface to clamp said cutting instrument against said second surface.

8. A blade sharpener according to claim 7, in which said second surface of said first jaw comprises a shoulder terminating in a ledge, said shoulder being at right angles to a longitudinal edge of said first jaw, said bolt and washer clamping one end of said cutting instrument to said shoulder.

9. A blade sharpener according to claim 1, in which the blade clamping means has a second jaw which comprises a leg, a clamp face provided at one end of said leg, a bolt with a hemispherical washer on its body, and a set screw with a domed nut, said leg having a hole with a concave bevelled lip to receive said bolt and said hemispherical washer, said bolt being threadable into a threaded hole in the second surface of the first jaw, said leg having a threaded hole to receive said set screw, said second surface of said first jaw having a detent dimensioned and located to receive said domed nut of the set screw; said hemispherical washer, said concave bevelled lip, said domed head and said detent coacting to allow non-parallel alignment of the clamp face of the second jaw with respect to the ledge of the second surface in two orthogonal directions; said second jaw, said bolt and said set screw comprising said means to clamp the cutting instrument against the first jaw.

10. A blade sharpener according to claim 9, in which said blade clamping means further comprises a resilient coupling adapted to be connected to said second end of said first jaw at one end thereof and to either said leg or said set screw at another end thereof, said resilient coupling biasing the clamp face of said second jaw away from the ledge of said first jaw.

11. A blade sharpener according to claim 9, in which said clamp face of said second jaw comprises a front face with an edge for clamping an arcuate portion for clearance to the cutting instrument, and a ledge opposite the front face and disposed to retain a blade of a pair of hand shears while another blade thereof is being clamped between said clamp face of said second jaw and the ledge of said first jaw.

12. A blade sharpener according to claim 9, in which said first jaw also comprises threaded holes located adjacent said second end and in said first surface, a clamp face fixed to said first surface of said first jaw by bolts extending into said threaded holes, said second jaw being clamped upon said first surface of said first jaw with a bolt of the blade clamping means, said set screw being positioned to space the leg of said second jaw from the first surface of said first jaw, said clamp face of said first jaw and said clamp face of said second jaw co-acting to clamp the cutting instrument therebetween, said second end of said first jaw being disposed uppermost.

13. A blade sharpener according to claim 12, further comprising a sharpening tool having a sharpening member and a rod fixed thereto, said rod being adapted to rest upon and be guided by said guide means, said sharpening member being disposed to bear against either the edge or the blade of said cutting instrument to sharpen the same, and a file attachment attached to one end of said rod and disposed to clamp a file to said rod.

14. A blade sharpener according to claim 13, in which said clamp face of said first jaw has a front face and a flat top, said flat top having protractor markings radiating away from said front face, said sharpening tool being disposed parallel to the protractor markings.

* * * * *